US007390992B2

(12) United States Patent
Morgandi

(10) Patent No.: US 7,390,992 B2
(45) Date of Patent: Jun. 24, 2008

(54) HEAT BLANKET

(75) Inventor: Arturo Morgandi, Bergamo (IT)

(73) Assignee: Imetec S.p.A., Azzano, S. Paolo (BG) (IT)

( * ) Notice: Subject to any disclaimer, the term of this patent is extended or adjusted under 35 U.S.C. 154(b) by 97 days.

(21) Appl. No.: 10/568,031

(22) PCT Filed: Aug. 14, 2003

(86) PCT No.: PCT/IT03/00510

§ 371 (c)(1),
(2), (4) Date: May 25, 2006

(87) PCT Pub. No.: WO2005/018281

PCT Pub. Date: Feb. 24, 2005

(65) Prior Publication Data

US 2006/0289454 A1 Dec. 28, 2006

(51) Int. Cl.
*H05B 1/02* (2006.01)

(52) U.S. Cl. ..... 219/481; 219/212; 219/497; 219/506

(58) Field of Classification Search ..... 219/212, 219/481, 494, 497, 501, 506, 505
See application file for complete search history.

(56) References Cited

U.S. PATENT DOCUMENTS 5,105,067 A 4/1992 Brekkestran et al.
5,420,397 A * 5/1995 Weiss et al. ..... 219/501
5,770,836 A * 6/1998 Weiss ..... 219/481

(Continued)

FOREIGN PATENT DOCUMENTS

FR 2785138 A 4/2000
WO WO 0124580 A 4/2001

OTHER PUBLICATIONS

International Search Report for PCT/IT2003/000510.

*Primary Examiner*—Mark Paschall
(74) *Attorney, Agent, or Firm*—Husch & Eppenberger LLC; Robert C. Haldiman

(57) ABSTRACT

The heat blanket (10) comprises an operative unit (20) and a control/power supply unit (40) which can be electrically connected on one side to the power mains and on the other side to the operative unit (20). The operative unit (20) comprises a foldable sheet (21) and a linear heating element (22) distributed in the sheet (21), with a first and second conductor extending one along the other, separated by a first electrically insulating material and enclosed by a second electrically insulating material; the first and second conductor are electrically connected to the control/power supply unit (40) and have respective first terminals inside the panel which are connected together. The control/power supply unit (40) comprises a power supply group (41) for the heating element (22), intended for the connection to the electric mains, and a microprocessor configured to control the power supply for the heating element (22). The control means comprise a cut-off group (45) of the power supply for the heating element, a microprocessor (50), connected to the heating element (22), to the power supply group (41) and to the cut-off group (45), set to detect possible anomalies in the power supply conditions of the heating element (220 and to act on the switch group interrupting the power supply of the heating element when said anomalies occur.

20 Claims, 2 Drawing Sheets

U.S. PATENT DOCUMENTS 6,563,090 B1 5/2003 Wu
2001/0008236 A1 7/2001 Allard
2002/0195442 A1* 12/2002 Lee ..... 219/505
2003/0047556 A1 3/2003 Armando et al.
2003/0052120 A1* 3/2003 Zabrowsky et al. ..... 219/501

* cited by examiner

FIG. 1
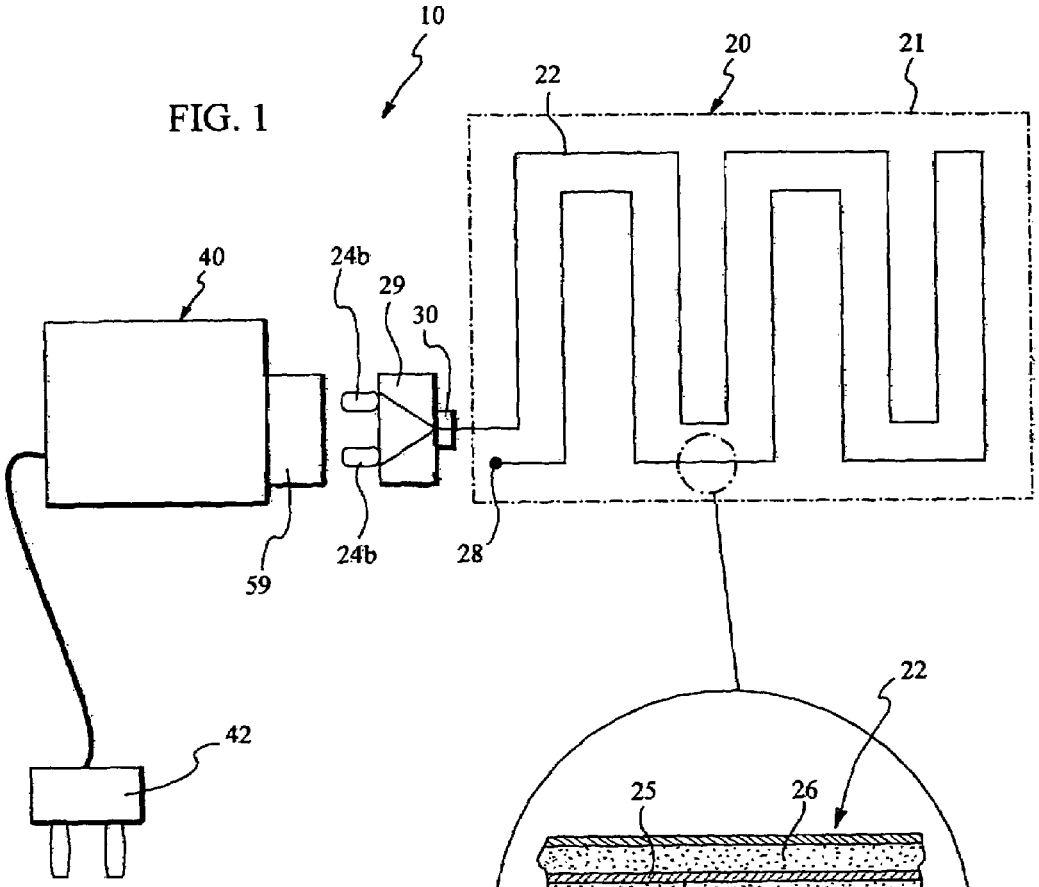
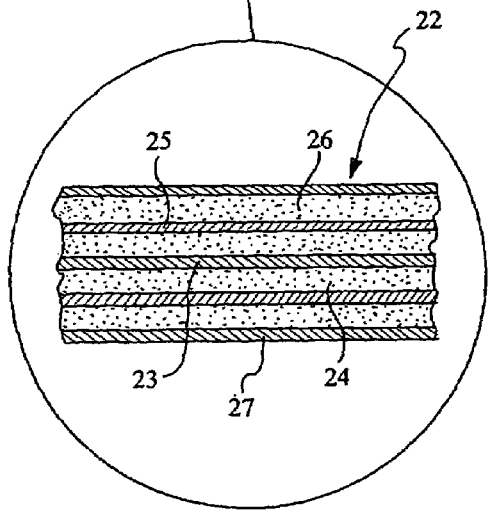
FIG. 2

HEAT BLANKET

CROSS-REFERENCE TO RELATED APPLICATIONS

This application claims priority to PCT/IT2003/000510 filed on Aug. 14, 2003.

The present invention refers to a heat blanket, also known as electric blanket, intending to indicate with this term a heating apparatus mainly (but not exclusively) intended for heating a bed or a person in bed, having flat shape and any dimensions (i.e. either such as to completely cover a bed or such as to cover only a portion thereof).

Heat blankets have for some time been known, and in general provide an operative unit and a control/power supply unit; the two units can be permanently connected together or else can be separate and electrically connectable. The operative unit comprises a foldable sheet and a linear heating element distributed in the sheet, moreover with a snake-like progression, having a path such as to promote (or rather, not hinder too much) folding of the sheet.

Usually, the heating element comprises a first and a second coaxial conductors, with the first conductor wound in a spiral around an electrically insulating core, generally textile, and with the second conductor wound in a spiral around the first conductor, with the interposition of an electrically insulating material; the whole is enclosed within a further electrically insulating material. The heat is produced electrically by Joule effect in the conductors, and from here is distributed in the sheet.

It can immediately be understood and, moreover, it is well known in the field that a product of this type is potentially dangerous to the user, also because often it is used by users with characteristics (sick people, old people, children) such that inattentive if not actually incorrect use must be foreseen.

Just to quote an example of a typical situation of potential risk, the sheet could be incompletely laid out during the operation of the blanket, i.e. it could have folded parts; in the fold zone, there is thus an overheating due to the overlapping of more heating layers, and a mechanical flexing stress on the heating element with the possible risk of breaking of the electric conductors. Another example of a potentially dangerous situation is the resting of a foreign body on the sheet: a normal blanket, a duvet, a pillow, but also a bag or even a pet or a person; also in this case there is, indeed, local overheating, due to the hindrance to the dispersal of the heat produced. Clearly, the situation is further worsened if the two events happen simultaneously, in the same zone of the sheet. Overheating is dangerous because it is a possible source of fire; the breaking of the electric conductors can cause sparking and therefore also fire.

Therefore, it is known in the field to equip heat blankets with safety systems to protect users from risks also in case of more or less improper use.

A system which has had a certain success provides that the inner insulating material which separates the two heating conductors has a relatively low melting point with respect to that of the outer insulating material, so that in case of overheating the inner insulating material melts, bringing the two conductors to touch each other with a short circuit, without, however, the outer insulating material being altered. Such a short circuit determines a further local overheating, which—with a sort of avalanche effect—in a very short time leads to the melting of a large portion of inner insulation, until the increased electric absorption due to the ever increasing short circuit reaches a value such as to cause the intervention of a fuse. The heat blanket in such a way has clearly become unusable, but the risk of fire should have been avoided.

The present invention addresses the problem of further improving the safety conditions of a heat blanket.

Consequently, this invention concerns a heat blanket comprising an operative unit and a control/power supply unit which can be electrically connected on one side to the power mains and on the other side to the operative unit, wherein:

a) the operative unit comprises:
- a foldable sheet,
- a linear heating element distributed in the sheet, with a first and a second conductor extending one along the other, separated by a first electrically insulating material and enclosed by a second electrically insulating material, wherein the first and the second conductors are electrically connected to the control/power supply unit and have respective first terminals inside the panel, connected together; and b) the control/power supply unit comprises:
- a power supply group for the heating element, intended for connection to the electric mains,
- control means of the power supply for the heating element, characterised in that the control means comprise:
- a power supply cut-off means for the heating element,
- a microprocessor, connected to the heating element, to the power supply group and to the cut-off group, set to detect possible anomalies in the power supply conditions of the heating element and to act upon the cut-off group interrupting the power supply of the heating element when said anomalies take place.

The use of a microprocessor allows the variation of the power supply conditions in the heating element to be recognised with the maximum accuracy, and thus ensures rapidity and versatility of intervention in case of anomalies, substantially improving the safety of the apparatus.

The control/power supply unit can be permanently electrically connected to the operative unit. Preferably, however, for greater ease of use and to allow the possible replacement of just one of the two units in case of a failure, the two units are distinct and separable, a removable electric interconnection joint being provided on the one hand in the control/power supply unit and on the other hand on second terminals of the conductors of the heating element.

Preferably, the anomalies which make the microprocessor intervene include one or more of the following conditions:
- interruption of electric conduction in the heating element;
- short circuit in the heating element;
- overheating of the heating element;
- need or suitability of periodic maintenance.

In all of these cases, indeed, it is considered suitable to interrupt the power supply of the heating element. In the first case, a breakage of the conductor could have happened, which as seen is a source of a fire hazard. In the second case, the fire hazard is clear and immediate. The third case could lead to a short circuit.

Moreover (fourth case) it is preferable to intervene preventatively, should conditions have been reached in which it would be advisable to subject the heat blanket to maintenance by a specialised laboratory. The conditions which make it advisable to have a maintenance check can be various; for example, they can be conditions linked to the life of the heat blanket, such as one or more of the following:
- total switched-on time of the blanket;
- total lifetime of the blanket;

total number of switching-on/off cycles undergone by the blanket;

number and type of anomalies detected.

According to a preferred characteristic of the invention, each anomaly detected is classified by the microprocessor, either as a temporary anomaly or as a definitive anomaly, whereas the interruption of the power supply of the heating element is reversible in case of temporary anomaly and irreversible in case of definitive anomaly. In this way, an anomaly in any case determines the interruption of the power supply, preventing situations of danger; however, the following behaviour is differentiated according to the type of anomaly detected. Indeed, some anomalies may be due to temporary problems which can be corrected by itself or with a small intervention by the user; this is the case, for example, of overheating (after it has been cooled down the conditions can once again be perfectly safe), or else of interruption of electric conduction in the heating element (this could simply be due to an imperfect electric coupling between the operative and control/power supply units). On the other hand, a situation of short circuit is certainly a source of ranger, whatever its cause, and it is thus advisable to exclude the possibility of even just an attempt to switch it back on. A request for a periodical maintenance check may be classified either as a temporary anomaly, or as a definitive anomaly. The first case is preferable if one wishes to leave the user with a certain freedom, whereas the second case is preferable if one wishes to prioritise safety. A block due to a definitive anomaly can be nullified only by an intervention of the authorised assistance service.

Preferably, a temporary anomaly is reclassified by the microprocessor as a definitive anomaly if it reoccurs a predetermined number of times consecutively. The reoccurrence of the same anomaly, indeed, is normally an indication of a permanent structural problem, which thus would make it advisable to prevent further attempts at switching on. This is also valid for a request for maintenance (if classified as a temporary anomaly), if it is ignored too many times.

Preferably, the first electrically insulating material has a melting point of between 100 and 160° C., more preferably equal to about 120° C.; such a material can, for example, be polyethylene. The second electrically insulating material, on the other hand, has a melting point of at least 170° C.; such a material can, for example, be PVC.

Preferably, the cut-off group comprises, in series on the power supply of the conductors, a first electronic operating switch, which activates or deactivates the electric conduction upon the command of the microprocessor based upon the temperature of the heating element. This electronic switch commanded by the microprocessor thus carries out the function of keeping the temperature of the heating element stable at the desired level.

To get an indication of the temperature of the heating element, preferably the electric resistance of the heating element increases as the temperature increases and the microprocessor detects the temperature of the heating element by a measurement of such an electric resistance.

Preferably, the heat blanket comprises an adjustable setting group of the temperature of the heating element connected to the microprocessor, and the first electronic operating switch activates or deactivates the electric conduction upon the command of the microprocessor based upon the setting of the adjustable setting group of the temperature of the heating element. The possibility of adjusting the temperature, easily obtained by exploiting the microprocessor, improves the performance of the heat blanket.

The heat blanket as described up to here is able—as seen—to provide a high degree of safety for the user. However, such a degree of safety can be improved further; for such a purpose, preferably the cut-off group comprises, in series on the power supply of the conductors and in series with the first electronic operating switch, a second electronic emergency switch. This electronic emergency switch intervenes in case of failure of the microprocessor, and can be made and can operate in various ways.

In a first preferred version, the second electronic emergency switch is such as to interrupt the circuit unless it is receiving a predetermined signal dependent upon an output signal from the microprocessor. In this way, as soon as failure prevents the microprocessor from emitting the foreseen signal, the emergency switch immediately interrupts the power supply to the conductors of the heating element. In other words, there is a targeted intervention dependent upon failure in the microprocessor.

In another more preferable version, the second electronic emergency switch is such as to interrupt the circuit in the case in which the resistance of the heating element exceeds a predetermined limit, independently of any command of the microprocessor. In this version, the intervention takes place irrespective of the operating conditions of the microprocessor, but rather it depends only upon the fact that extreme conditions have been reached, which must not be exceeded to avoid a dangerous situation. Indeed, a high anomalous resistance value in the heating element means that a significant failure or an interruption of a conductor (theoretically infinite resistance) or else substantial overheating has occurred.

Preferably, the heat blanket comprises a signal indicator light, commanded by the microprocessor according to specific and different indication cycles depending from the classification of the anomaly detected. In such a way, the user is informed of the fact that there has been an anomaly, and also of the type of anomaly; he can thus immediately understand whether the heat blanket is irreparably damaged, or whether, on the other hand, something must be done to restore the conditions which allow it to operate, like for example checking the connection between operative unit and control/power supply unit, or else waiting for the blanket to cool down before trying to switch it on again.

The aforementioned signal indicator light can also be used for other functions. For example and preferably, the heat blanket comprises a timer for the automatic interruption of the power supply of the blanket after a predetermined time (fixed or able to be selected by the user), such an automatic interruption being indicated by a specific indication cycle of the signal indicator light. The signal indicator light thus carries out a complete informative function of the reasons why the heat blanket which is switched on it not working.

Preferably, the heat blanket comprises an on-off indicator light, to indicate the power supply of the blanket, and more preferably such on-off indicator light also provides an indication of the temperature adjustment set by the user. The on-off indicator light thus carries out the function of indicating what the user has set.

The functions of the signal indicator light and of the on-off indicator light can be carried out by the same light. However, to improve the intelligibility of the information given by such lights, the signal indicator light and of the on-off indicator light are distinct and different from each other, so that the user has a visual confirmation of his/her own settings (switching on and temperature adjustment) from the latter, and information relative to the operating anomalies of the heat blanket from the former.

Still in order to improve the safety of the heat blanket, the microprocessor is such as to automatically and periodically activate a self-diagnostic procedure, with which it simulates a failure, checks the correct intervention of the cut-off group and finally either goes back into operation in case of regular operation of the cut-off group or else indicates an anomaly in case of irregular operation of the cut-off group. This functionality, preferably added to the other illustrated above, truly maximises the safety of the heat blanket, keeping the user safe from any risk.

Further characteristics and advantages of a heat blanket according to the invention shall become clearer from the following preferred description of its preferred embodiments, given with reference to the attached drawings.

In such drawings:

FIG. 1 is a schematic view of a heat blanket according to the invention;

FIG. 2 is an enlarged section view of a detail of the heating element of the blanket of FIG. 1;

Figure 3:
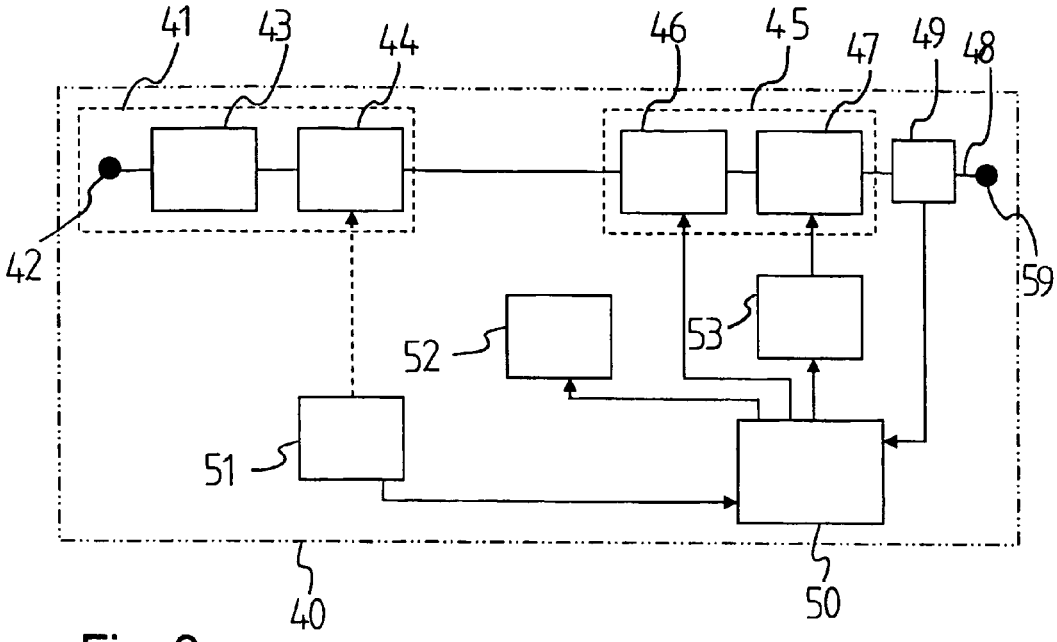
FIG. 3 is a block diagram of the power supply/control unit of the blanket of FIG. 1.

In the figures, a heat blanket is wholly indicated with 10, which comprises an operative unit 20 and a power supply/control unit 40.

With particular reference to FIG. 1 and to FIG. 2, the operative unit 20 comprises a foldable sheet 21, made from sheeted material, woven or non-woven, in which a linear heating element 22 is arranged. The heating element 22 is substantially distributed in all of the surface of the sheet 21 according to a snake-like progression such as to cause the minimum possible hindrance to the folding of the sheet 21.

The heating element 22 has a coaxial structure, with a textile core 23, a first conductor 24 would helically on the core 23, a first insulating material or inner insulator 25, a second conductor 26 wound helically on the inner insulator 25, a second insulating material or outer insulator 27. The textile core 23 is preferably made from polyester thread. The first and second insulating material 25 and 27 have respective melting points of between 100 and 160° C. and greater than 170° C.; preferably, the first insulating material 25 is polyethylene with a melting point of about 120° C., whereas the second insulating material 27 is PVC with a melting point of about 180° C.

The conductors 24 and 26 are preferably made from heat-resistant material, i.e. material having variable resistivity (in particular increasing) with the temperature, for example consisting of a 99/1 copper-cadmium alloy. They have respective first terminals 24*a* and 26*a* inside the sheet 21 and respective second terminals 24*b* and 26*b* protruding outside the sheet 21. The first terminals 24*a* and 26*a* are electrically joined, through direct connection 28. The second terminals 24*b* and 26*b* are, on the other hand, enclosed in a jack 29, mounted on the heating element 22 and accessible from outside the sheet 21.

With particular reference to FIG. 3, the power supply/control unit 40 comprises—according to an embodiment of the invention—a power supply group 41, which in turn comprises a plug 42, possibly a general switch 43, and an on-off indicator light 44. The power supply/control unit 40 also comprises a cut-off group 45, which in turn comprises a first operating switch 46 and a second emergency switch 47, mounted in series on an electric supply line of the operative unit 20; both of such switches are electronic, i.e. they are SCR, TRIAC or MOSFET or equivalent components which maintain the conduction conditions in the presence of a predetermined pilot signal.

The power supply/control unit also comprises a microprocessor 50, an adjustable temperature setting group 51, a signal indicator light 52, an emergency intervention group 53, as well as a connector 59 at the end of the electric line 48 and suitable for the removable coupling with the jack 29 of the operative unit 20. The microprocessor 50 is connected to the other elements of the power supply/control unit 40 so as to receive input signals from the power supply line 48 and from the adjustable temperature setting group 51 and so as to send output signals (or rather control signals) towards the first operating switch 46, towards the emergency intervention group 53 and towards the signal indicator light 52. Such connections are made through per se known circuit elements and according to known methods (not described in detail nor illustrated in the figures), so as to obtain the operative characteristics which are illustrated hereafter.

The blanket 10, to be able to be used, must be connected to the electric mains through the plug 42 and must be assembled joining the operative unit 20 to the power supply/control unit 40 through the coupling of the jack 29 with the connector 59.

The switching on of the blanket 10 is obtained by acting upon the general switch 43, if present; in a simplified version that is not illustrated such a switch can be left out, and thus switching on takes place directly with the connection of the plug 42 to the electric mains. If the adjustable temperature setting group 51 is present, the user sets the desired temperature acting upon such a group; this element can also be left out in a simplified version that is not illustrated, and then the temperature adjustment is simply fixed. With the blanket 10 switched on, the on-off indicator light 44 turns on.

In normal operation, the microprocessor 50 controls the operating switch 46, keeping it first in closed state; in the same way, the microprocessor 50 sends a signal to the emergency intervention group 53 which in turn keeps the emergency switch 47 in closed state. The operative unit 20 and in particular the heating element 22 is supplied with electric power.

In this step, the microprocessor 50 receives as input from a measurement block 49 a signal from the line 48 dependent upon the current flowing there, thus directly correlated with the electric resistance of the charge applied, or rather of the heating element 22; since the conductors 24 and 26 of the heating element 22 are heat-conductive, the aforementioned signal carries information directly linked to the temperature of the heating element 22 to the microprocessor 50. Such a signal from the measurement block 49 can, for example, be the voltage value at the ends of a very low precision resistance (for example 1 ohm) connected in series on the line 48 so as to be crossed by the current flowing there; when the blanket 10 is switched on, current flows in such a resistance and therefore a voltage is present, which decreases as the impedance in the heat-resistant heating element 22 increases, i.e. as the temperature of the heating element itself increases. Based upon such a signal, therefore, the microprocessor 50 is able to manage opening and closing cycles of the operating switch 46, so as to stabilise the temperature of the heating element 22 and thus of the operative unit 20.

The microprocessor 50 can include inside of it (or rather in its management logic) a timer, to automatically interrupt operation after a certain period of time, which may be predetermined or possibly adjustable, leaving the switch 46 open after such a period.

The adjustable temperature setting group 51 can advantageously be functionally associated with the on-off indicator light 44, so that such an indicator light also provides an indication of the temperature selected. For example, this can be obtained by providing that the command of the adjustable temperature setting group 51 takes place through a rotatable dial, placed over the light 43 and equipped with shaped openings with identifying characters of the temperature set.

If there is a short circuit in the heating element 22, such that the total impedance of the heating element itself reduces by a predetermined value, for example and preferably equal to 5%, for example because there has been overheating which has melted the inner insulator 25 bringing the two conductors 24 and 26 into contact in a point of the heating element 22 sufficiently far from the connection 28, the blanket 10 has clearly become unusable. Having detected this anomaly, the microprocessor 50 sends the emergency switch 47 an opening signal, blocking any further electric power supply of the heating element 22; the blocking situation is also maintained in case of switching off and back on again of the blanket 10 (through the general switch 43 or—if it is not present—by pulling out and reconnecting the plug 42 to the electric mains). Therefore, an anomaly of this type is considered definitive and the opening of the emergency switch 47 is irreversible. In parallel, the microprocessor 50 activates the signal indicator light 52 with a specific indication cycle (for example an indefinitely repeated intermittent flashing), so as to communicate the situation of definitive anomaly to the user so that he/she avoids pointlessly continuing the try to reuse a blanket 10 which can no longer work.

If, on the other hand, there is an interruption in electric conduction in whatever point of the electric circuit which is downstream of the power supply/control unit 40 (thus from the connection on the electronic board of the interconnection cable to all of the heating element 22), or else a lack of conduction at the time of switching on, the microprocessor 50 detects the anomaly and sends an opening signal to the switch 46. Consequently, the electric power supply to the heating element 22 is interrupted. An anomaly of this type may be due to irreversible deterioration of the heating element 22 (breakage of one of the conductors 24 or 26), a drawback as trivial and frequent as the lack of or incomplete coupling of the jack 29 with the connector 59, or to bad quality electric joints. This anomaly is thus classified by the microprocessor as temporary, and the opening of the emergency switch 47 is reversible. This means that the blanket 10 must be switched off, but at the next attempt to switch it on the microprocessor 50 once again checks the power supply conditions and if everything is working properly (because, for example, the user has correctly connected the jack 29 and the connector 59) sends the normal closing signal to the emergency switch 47. If, on the other hand, there is once again interruption of electric conduction in the heating element 22, the emergency switch 47 is left open.

Another anomaly which may occur is anomalous overheating of the heating element 22, due, for example, to an object being positioned on it which prevents the dispersal of the heat. This situation should not occur, due to the continuous temperature control operated by the microprocessor 50 acting on the operating switch 46, but if it did happen it would be an anomaly that could be the source of potential danger and therefore should be blocked. Therefore, when the microprocessor 50 detects an increase in temperature (through a gradual increase in electric resistance, different from a sharp and substantial increase due to an interruption in conduction), it sends an opening signal to the emergency switch 47. An anomaly of this type may be due either to irreversible deterioration of the heating element 22 or to a particular contingent situation.

This anomaly is then classified by the microprocessor as temporary, and the opening of the emergency switch 47 is reversible. This means that the blanket 10 must be switched off, but at the next attempt to switch it on the microprocessor 50 once again checks the power supply conditions and if everything is working correctly it sends a closing signal to the emergency switch 47. If, on the other hand, the anomaly occurs once again, the emergency switch 47 is left open.

At the same time as the intervention for a temporary anomaly, the microprocessor 50 activates the signal indicator light 52 with a specific sequence of flashes (for example a sequence of two flashes repeated indefinitely), so as to communicate the situation of temporary anomaly to the user so that he tries to check the connections or so that he waits for a certain time to cool down the blanket 10, and then try to switch it on again.

It is also possible for the microprocessor 50 to be set to reclassify the anomaly as definitive if it repeats a predetermined number of consecutive times when the blanket 10 is switched on, so as to communicate to the user that it is pointless to keep trying the switch it on because the blanket 10 has become unusable.

Moreover, the microprocessor 50 can advantageously be programmed to keep track of the life of the blanket 10, recording, for example, data relative to its total time of use and non-use, the number of times it has been switched on, how long they lasted, the temporary anomalies that have occurred, the absorption of current, etc.; of such data, according to the capabilities of the microprocessor 50, either all of the actual values, or average values, or minimums and maximums or any processing made with them can be stored. From this derives the possibility of indicating to the user (as a temporary anomaly or else autonomously) the suitability or possibly the need for a check or maintenance intervention. With this function it is possible to keep the ageing of the blanket 10 in check, which often forms the basis of malfunction and failure which may even be dangerous.

As just described, the microprocessor 50 is able to control and manage the operating anomalies in an optimal way. However, a failure of the microprocessor 50 itself cannot be ruled out. To initially tackle such a circumstance, the microprocessor 50 is of the type equipped with an inner safety device which resets the outputs of the microprocessor in case of failure; in such a way the signal is missing which keeps the operating switch closed 46 and the operation is blocked.

To further protect the user, the blanket 1 advantageously has the emergency intervention group 53, which in case of malfunction of the microprocessor 50 takes care of commanding the emergency switch 47 to open (or rather takes care of stopping the closing command).

Figure 4:
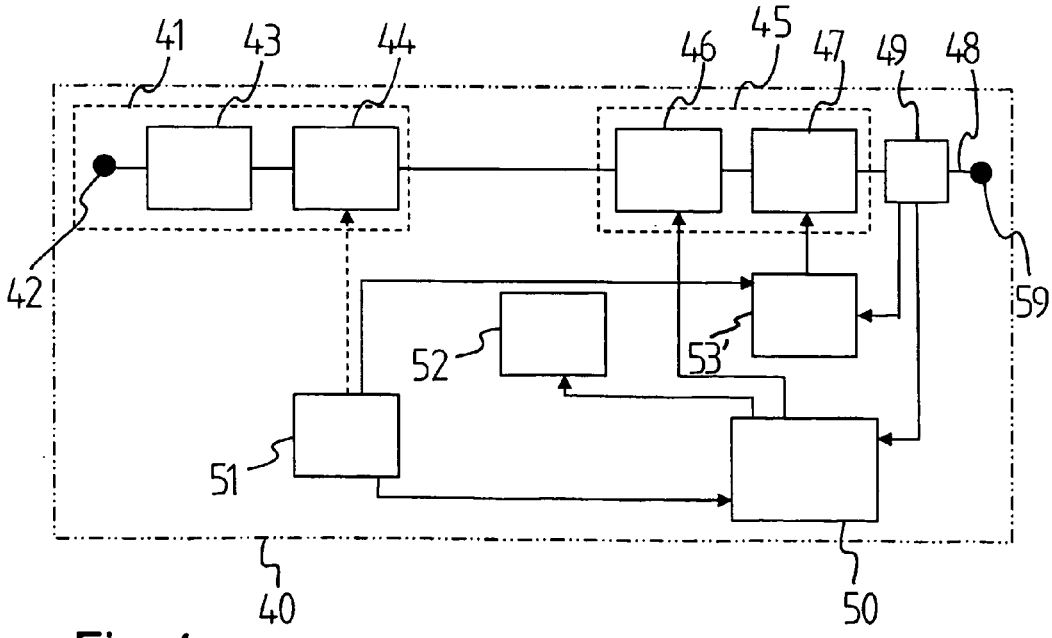
FIG. 4 is a block diagram of a variant of the power supply/control unit of FIG. 3.

Even greater protection can be obtained with the variant of FIG. 4, in which an emergency intervention group 53' is provided, which is commanded not by the microprocessor 50 but totally independently by the detection of the resistance in the heating element 22 operated by the measurement block 49. In the variant of FIG. 4, all of the other elements different from the emergency intervention group 53' are the same as the corresponding elements of the variant of FIG. 3; such elements are indicated with the same reference numerals and shall not be described any further.

Preferably, the emergency intervention group 53' has a variable intervention threshold, which can be adjusted together with the operating temperature through the adjustable setting group 51; indeed, the reaching of a certain temperature may or may not be an indication of failure and-therefore of danger according to the operating temperature set. If the intervention threshold of the group 53' is fixed, it must inevitably be fairly high to exclude an improper intervention if the user has set the maximum operating temperature. On the other hand, with a variable threshold together with the adjustment of the operating temperature, it is possible to ensure a quick intervention of the group 53' in whatever condition. When, for example, the group 51 is set on a low temperature, like in case of night use (for example 35° C.), the group 53' shall consequently be set on a relatively low temperature (for example 42° C.), so as to intervene in case of failure without temperatures such as to cause disturbance to the user being reached; when, on the other hand, the group 51 is set on a high temperature (for example 50° C.), the group 53' shall consequently be set on a relatively high temperature (for example 60° C.).

The microprocessor 50 of the blanket 10 can advantageously comprise a self-diagnosis function, in which the microprocessor 50 simulates its own failure and checks that the group 53 intervenes correctly. If this happens, i.e. if the intervention is correct, the microprocessor 50 restores normal operating conditions, otherwise it considers the event as a definitive anomaly.

Finally, in series with the heating element 22, a fuse 30 can be connected, which—in case of a strong current due to a short circuit in the heating element 22—has redundant protection capabilities with respect to the microprocessor 50 and to the unit 53 or 53', even if both shall normally be quicker at interrupting the circuit. The fuse can preferably be arranged in the connector 29.

The invention claimed is:

1. Heat blanket comprising an operative unit and a control/power supply unit which can be electrically connected on one side to the power mains and on the other side to the operative unit, wherein:

a) the operative unit comprises:
- a foldable sheet,
- a linear heating element distributed in the sheet, with a first and a
- second conductor extending one along the other, separated by a first electrically insulating material and enclosed by a second electrically insulating material, wherein the first and the second conductors are electrically connected to the control/power supply unit and have respective first terminals inside the panel, connected together; and b) the control/power supply unit comprises:
- a power supply group for the heating element, intended for connection to the electric mains,
- a controller of the power supply for the heating element, characterized in that the controller comprise:
- a power supply cut-off for the heating element,
- a microprocessor, connected to the heating element, to the power supply group and to the cut-off group, set to detect possible anomalies in the power supply conditions of the heating element and to act upon the cut-off group interrupting the power supply of the heating element when said anomalies take place;
- said microprocessor being further configured to classify each anomaly detected as a temporary anomaly or as a definitive anomaly; and
- said microprocessor being further configured to interrupt the power supply reversibly in the case of a temporary anomaly and to interrupt the power supply irreversibly in the case of a definitive anomaly.

2. Heat blanket according to claim 1, wherein said anomalies include one or more of the following conditions:
- interruption of electric conduction in the heating element;
- short circuit in the heating element;
- overheating of the heating element;
- need or suitability of periodic maintenance.

3. Heat blanket according to claim 1, wherein a short circuit in the heating element and/or a need or suitability of periodical maintenance are classified as a definitive anomaly.

4. Heat blanket according to claim 3, wherein a decrease in impedance greater than a predetermined value, preferably 5%, is considered a short circuit.

5. Heat blanket according to claim 1, wherein overheating in the heating element and/or an interruption in electric conduction in the heating element and/or a need for or suitability of periodical maintenance are classified as temporary anomalies.

6. Heat blanket according to claim 1, wherein a temporary anomaly is reclassified as a definitive anomaly if it repeats a predetermined number of times.

7. Heat blanket according to claim 1, wherein the first and second conductor are coaxial, the first conductor being wound in a spiral around a core, the second conductor being wound in a spiral around the first conductor with interposition of the first electrically insulating material, and wherein the first electrically insulating material has a melting point of between 100 and 160° C., preferably equal to about 120° C.

8. Heat blanket according to claim 1, wherein the cut-off group comprises, in series on the power supply of the conductors, a first electronic operating switch, which activates or deactivates the electric conduction upon the command of the microprocessor based upon the temperature of the heating element.

9. Heat blanket according to claim 8, wherein the electric resistance of the heating element increases as the temperature increases and wherein the microprocessor detects and wherein the temperature of the heating element by a measurement resistance of such an electric resistance.

10. Heat blanket according to claim 8, comprising an adjustable setting group of the temperature of the heating element connected to the microprocessor, and wherein the first electronic operating switch activates or deactivates the electric conduction upon the command of the microprocessor also based upon the setting of the adjustable setting group of the temperature of the heating element.

11. Heat blanket according to claim 8, wherein the cut-off group comprises, in series on the power supply of the conductors and in series with the first electronic operating switch, a second electronic emergency switch.

12. Heat blanket according to claim 11, wherein the second electronic emergency switch is such as to interrupt the circuit unless it is receiving a predetermined signal which is dependent upon an output signal from the microprocessor.

13. Heat blanket according to claim 11, wherein the second electronic emergency switch is such as to interrupt the circuit in the case in which the resistance of the heating element exceeds a predetermined threshold, independently of any command of the microprocessor.

14. Heat blanket according to claim 13, wherein the predetermined threshold is adjustable through the adjustable temperature setting group.

15. Heat blanket according to claim 1, comprising a signal indicator light, commanded by the microprocessor according to specific and different cycles according to the classification of the anomaly detected.

16. Heat blanket according to claim 15, comprising a timer for the automatic interruption of the power supply of the heat blanket after a predetermined time, such an automatic interruption being indicated by a specific indication cycle of the signal indicator light.

17. Heat blanket according to claim 15, comprising an on-off indicator light, to indicate the electric power supply of the heat blanket.

18. Heat blanket according to claim 15 wherein the signal indicator light and the on-off indicator light are distinct and different from each other.

19. Heat blanket according to claim 15, wherein the microprocessor automatically and periodically activates a self-diagnosis procedure, simulating its own failure, checking the correct intervention of the cut-off group and finally either restoring its operation in case of correct operation of the cut-off group or else indicating an anomaly in case of irregular operation of the cut-off group.

20. Heat blanket according to claim 2 wherein the need or suitability of programmed maintenance is established by the microprocessor based upon one or more of the following parameters:

total time that the blanket has been switched on;

total lifetime of the blanket;

total number of switching on and off cycles undergone by the blanket;

number and type of anomalies detected.

* * * * *